US005624383A

United States Patent [19]

Hazard et al.

[11] Patent Number: 5,624,383

[45] Date of Patent: Apr. 29, 1997

[54] METHOD OF AND MEANS FOR PROVIDING FORCE FEEDBACK IN CONTINUOUS PASSIVE MOTION SYSTEMS

[75] Inventors: Rowland G. Hazard, Burlington; Steven M. Reinecke, Hinesburg, both of Vt.

[73] Assignee: Ergomedics, Inc., Winooski, Vt.

[21] Appl. No.: 199,784

[22] Filed: Feb. 22, 1994

Related U.S. Application Data

[63] Continuation-in-part of Ser. No. 887,877, May 26, 1992, abandoned.

[51] Int. Cl.[6] ..... A61H 1/00

[52] U.S. Cl. ..... 601/5; 601/148

[58] Field of Search ..... 128/774, 781, 128/782; 606/237–240; 601/5, 148, 149, 23, 24, 26

[56] References Cited

U.S. PATENT DOCUMENTS

| | | | |
|---|---|---|---|
| 2,193,822 | 3/1940 | Petersen | 606/239 |
| 2,193,882 | 3/1940 | Petersen . | |
| 2,240,679 | 5/1941 | Stauffer | 606/237 X |
| 2,307,331 | 1/1943 | Parker, Jr. . | |
| 2,716,443 | 8/1955 | Laughlin . | |
| 2,756,808 | 7/1956 | Eichorst . | |
| 3,596,654 | 8/1971 | Tamura | 601/31 X |
| 3,974,827 | 8/1976 | Bodeen | 606/237 |
| 4,321,044 | 3/1982 | Kron . | |
| 4,516,568 | 5/1985 | Baxter et al. . | |
| 4,574,786 | 3/1986 | Hashimoto et al. . | |
| 4,669,455 | 6/1987 | Bellati | 606/240 X |
| 4,762,134 | 8/1988 | Parker, Jr. | 606/239 |
| 4,833,614 | 5/1989 | Saitoh et al. | 297/284.6 |
| 4,860,733 | 8/1989 | Gala | 128/781 |
| 4,875,470 | 10/1989 | Cotone . | |
| 4,928,959 | 5/1990 | Bassett et al. . | |
| 4,981,131 | 1/1991 | Hazard | 128/38 |
| 5,022,385 | 6/1991 | Harza . | |
| 5,024,650 | 6/1991 | Hagiwara et al. . | |
| 5,033,457 | 7/1991 | Bonutti . | |
| 5,033,458 | 7/1991 | Sperr . | |
| 5,078,152 | 1/1992 | Bond et al. . | |
| 5,083,552 | 1/1992 | Lipowitz | 601/1 |
| 5,088,475 | 2/1992 | Steffensmeier . | |
| 5,099,702 | 3/1992 | French | 73/862.68 |
| 5,099,828 | 3/1992 | Duke . | |
| 5,103,808 | 4/1992 | Iams et al. . | |
| 5,165,390 | 11/1992 | Fleetwood . | |
| 5,255,188 | 10/1993 | Telepko | 601/5 X |
| 5,343,876 | 9/1994 | Rogers | 128/870 |

FOREIGN PATENT DOCUMENTS

| | | |
|---|---|---|
| 0128534 | 12/1984 | European Pat. Off. . |
| 1256840 | 3/1965 | Germany . |
| 2339069 | 8/1973 | Germany . |
| 2441705 | 8/1974 | Germany . |
| 462179 | 3/1937 | United Kingdom . |
| WO83/00620 | 3/1983 | WIPO . |
| 8300620 | 3/1983 | WIPO . |
| WO91/06274 | 5/1991 | WIPO . |

*Primary Examiner*—Robert A. Hafer
*Assistant Examiner*—Brian E. Hanlon
*Attorney, Agent, or Firm*—Choate, Hall & Stewart

[57] ABSTRACT

Method and apparatus for providing force feedback in continuous passive motion systems for use in treating or preventing low back pain. A mechanism adjacent to a static back support is provided to initiate continuous passive motion for the lumbar area in order to produce substantial lordotic motion for the spine. A force measuring apparatus is provided for continuously measuring the force exerted by the mechanism on an individual's lumbar area and a system controls the force exerted by the mechanism in order to build up to and then maintain a predetermined force on the lumbar area of the user. Thereafter, a predetermined time is selected to allow the lordotic position of the spine to be returned to its original state.

7 Claims, 3 Drawing Sheets

METHOD OF AND MEANS FOR PROVIDING FORCE FEEDBACK IN CONTINUOUS PASSIVE MOTION SYSTEMS

This is a continuation-in-part application of the application Ser. No. 07/887,877 filed on May 26, 1992, now abandoned.

BACKGROUND OF THE INVENTION

This invention pertains to continuous passive motion methods and means, and in particular, to such continuous passive motion methods and means as they are applied in the treatment and/or prevention of back pain and the providing of back comfort, Back pain is a very widespread malady in the United States. Lower back pain can be caused by disease, injury or congenital defect. There are many different types of relevant therapeutic machines on the market today. There have been a number of patents issued in the continuous passive motion field including the U.S. Pat. No. 4,981,131, issued to the applicant Rowland G. Hazard for a Passive Motion Back Support. This patent shows a pneumatic based apparatus for providing continuous passive motion in treating or preventing back pain. A number of devices provide mechanical apparatus for the same purpose. The key difficulty inherent in these designs and requiring solution in order to optimize the user's comfort is the need for integrated automatic force feedback to control the support devices. Without such feedback, devices cannot accommodate variations in the user's spinal compliance, posture and position while providing the desired spinal mobilization comfortably and safely. What is needed is a method and means that will provide force feedback for mechanical and pneumatic devices that deliver back support and/or continuous passive spinal motion. A type of device related to providing massage is shown by the U.S. Pat. No. 5,083,552 issued to Lipowitz for a device that provides vertical compression for the user very rapidly giving a massage effect. The high and low pressure limits of Lipowitz are continuously cycling in the very fast cycle time of half a second to two seconds in order to provide massage. As opposed to the type of control, which is only adequate for massage, safe and comfortable spinal mobilization through a continuous passive motion support requires a pressure feedback system with operating characteristics which vary between phases of the motion cycles. What is also needed is a device and a method which builds up to a preset force range and then holds the force constant for a minimum of five seconds or more during which time movement may or may not occur.

It is the object of this invention to teach a method of and means for providing force feedback in continuous passive motion systems which avoids the disadvantages and limitations, recited above. Another object of this invention is to provide force feedback for producing spinal motion using a prolongation of certain phases of cycle time in order to have the user remain comfortable and safe.

SUMMARY OF THE INVENTION

Particularly, it is the object of this invention to teach a method for providing force feedback in continuous passive motion systems, for use in treating and preventing low back pain and providing back comfort in an individual, comprising the steps of providing at least one static back support; providing a mechanism adjacent to said static back support to initiate continuous passive motion for the lumbar area in order to produce significant lordotic motion for the spine; providing a timer for the basic control of the mechanism; providing a system for measuring the force exerted by the mechanism on an individual's lumbar area; providing a system for continuous and automatic controlling the force exerted by the mechanism on the individual's lumbar area in order to build up and then maintain a predetermined force on the lumbar area of the user for a predetermined period of time; and providing a predetermined period of time to allow the lordotic position of the spine to be returned to its original state. It is also the object of the invention to teach a method for providing force feedback in continuous passive motion systems, for use in treating or preventing low back pain and providing back comfort in an individual, comprising the steps of providing at least one static back support; providing a mechanism adjacent to said static back support to initiate continuous passive motion for the lumbar area in order to produce significant lordotic motion for the spine; providing a system for continuous measuring the force exerted by the mechanism on an individual's lumbar area; providing a system for continuously and automatically controlling of the force exerted by the mechanism on an individual's lumbar area; and providing a predetermined period of time to allow the lordotic position of the spine to be returned to its original state. It is also the object of this invention to teach means for providing force feedback in continuous passive motion systems, for use in treating or preventing low back pain and providing back comfort in an individual, comprising back support means; said back support means comprising at least one static back support; said back support means having a continuous force applying section adjacent to said static back support; said force applying section having a mechanism for initiating continuous passive motion to an individual's lumbar area by said force applying section in order to produce significant lordotic motion for the spine; continuous force measuring means; logic system means for continuous and automatic controlling of the operation of said force applying section based upon the measurements obtained from said force measurement means; and said continuous force measuring means comprising transducers that continuously monitor values below, equal to and above the predetermined levels and submit those values to said logic system in order to maintain a predetermined force on the lumbar area of the user for a predetermined period of time. Finally, it is the object of this invention to teach means for providing force feedback in back support systems for use in treating and preventing back pain and providing back comfort in an individual, comprising back support means; said back support means comprising at least one static back support; said back support means having a continuous force applying section adjacent to said static back support; continuous force measurement means; and logic system means for continuous and automatic controlling of the operation of said force applying section based upon the measurements obtained from said continuous force measurement means.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 3:
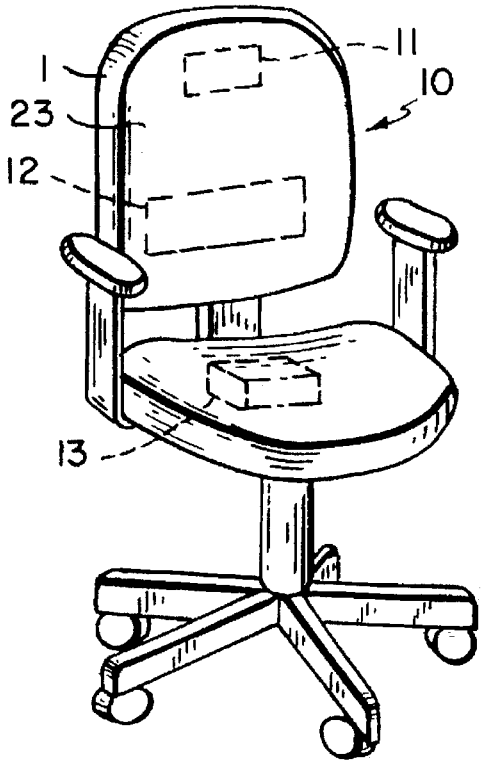
FIG. 3 is a perspective view of the novel means in position in a chair.
Figure 4:
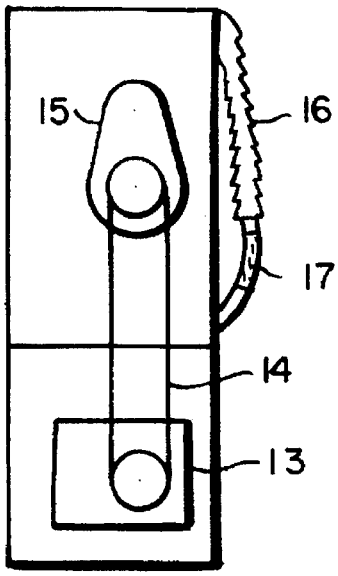
FIG. 4 is a side elevational view of the novel means in the form of a cam driven mechanical device.
Figure 5:
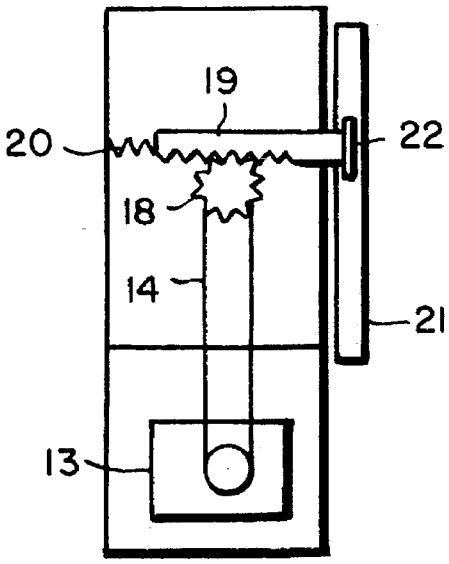
FIG. 5 is a side elevational view of a rack and pinion mechanical device.

As shown in the figures, the novel means 10 comprises a logic box 11 that is positioned in a chair 1 having an approximately vertical, firm back support 23. The means have various continuous passive motion support 12 adjacent to the firm back support that comprise a bladder which is inflated or deflated or a solid panel which is moved forward and backward and have some type of motor (mechanical) or pneumatic drive 13. It should be noted that the different number of mechanical or pneumatic drives are not used simultaneously or even in conjunction with each other. Only one single mechanical or pneumatic drive would be used independently. Two examples of mechanical drives are shown. In FIG. 4, a cam driven device is highlighted. The device shows the motor 13 connected to a cam drive 15 by means of a belt 14. The device has a flexible support panel 16 and a load cell or transducer 17 to measure force being applied to the user's back. The cam 15 drives the support panel 16. As shown in FIG. 5, the mechanical device is driven by means of a rack and pinion arrangement. The device has a motor 13 driving a pinion 18 using a belt 14. The pinion 18 activates piston 19 which, in turn moves support panel 21. A compression spring 20 is used to counterbalance the actions of the piston 19. The support panel contains a load cell or transducer 22. A spring and cable type mechanical system could also be used. A pneumatic apparatus, as described in applicant's previous patent can also be fitted with the logic system and the force sensing devices. The motion support 12 in FIG. 3 is shown for the purposes of clarity in FIG. 4 as number 16 and in FIG. 5 as number 21. In pneumatic devices, the force transducer is positioned within the bladder or connecting fluid conduit. In mechanical devices, the transducer is positioned such that it measures the force exerted by the support against the user's lumbar area. In all pneumatic and mechanical embodiments, therefore, the force exerted against the lumbar area is continuously monitored throughout the forward and backward phase of the spinal motion cycles.

Figure 1:
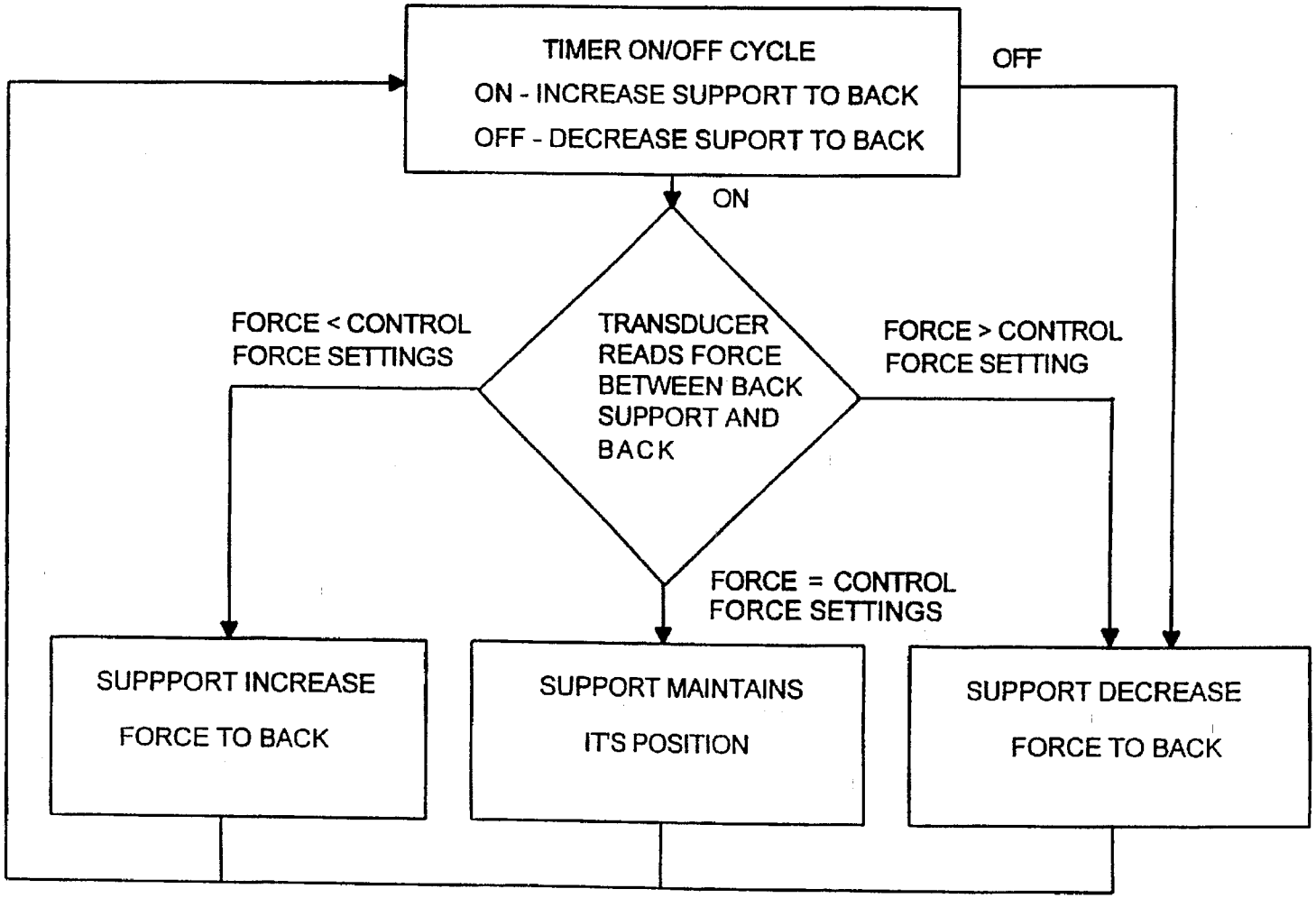
FIG. 1 is the logic chart of the logic system means.
Figure 2:
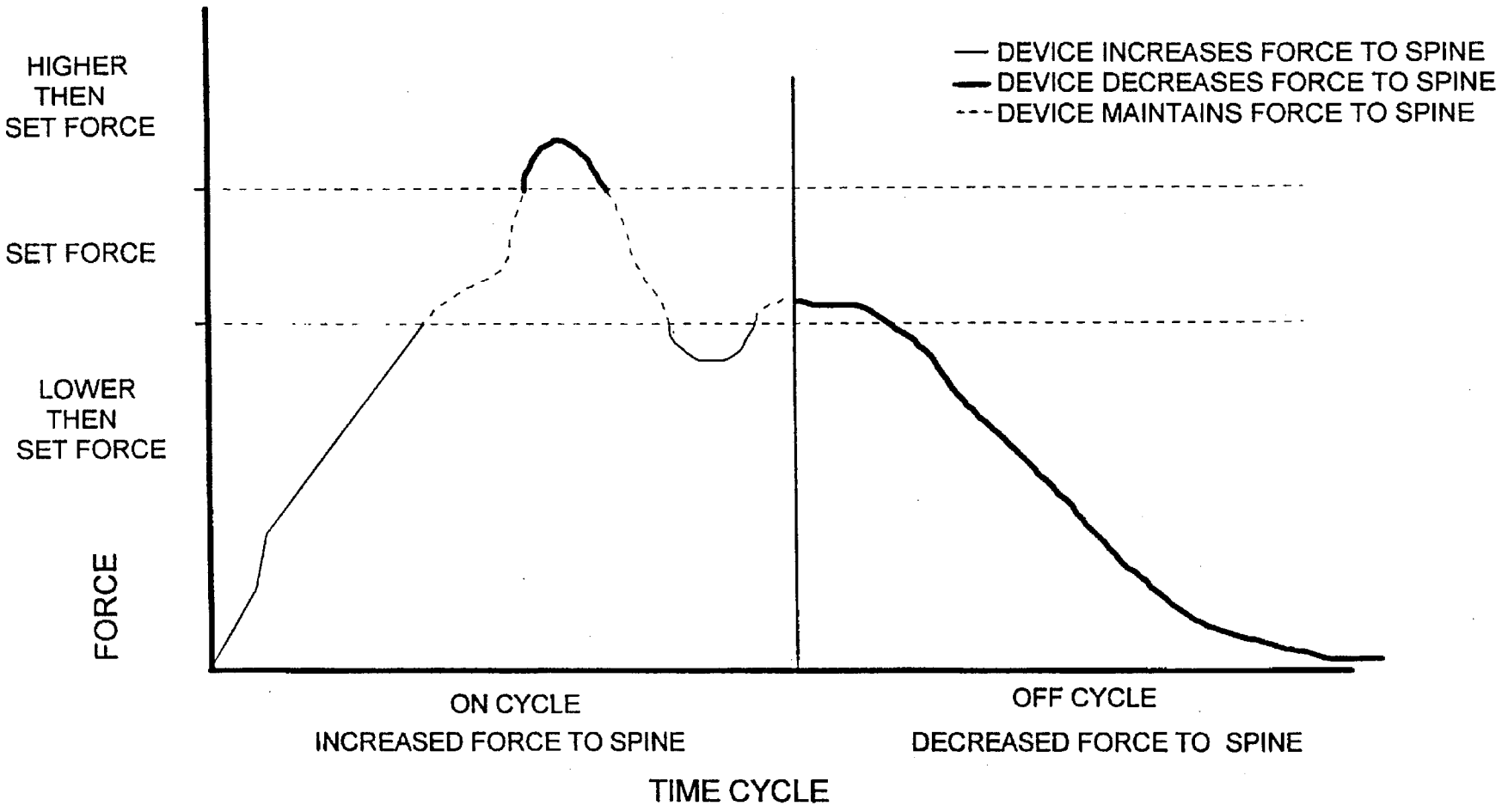
FIG. 2 is the chart of the feedback cycle of a continuous passive motion backrest through a full cycle of increasing and decreasing force induced to the spine.

All the above-described means provide a backward and forward motion of a support that is in contact with an individual's back. The motion includes lordotic and kyphotic movements of the spine such that flexion and extension alternately occur between adjacent vertebrae. The mechanisms cyclically impose increasing and decreasing force against the user. The control of the motion cycle duration can be accomplished by means of an adjustable timer. The logic system monitors and controls the amount of force to the user's back by regulating the motor inducing the force. The key to the goal of inducing effective, safe lordotic range to the spine (typically 9 degrees) is to accomplish it using a slow, continuous motion (typically, cycle rates greater than five seconds) while continuously monitoring the force used. Using feedback from the force transducer, the logic system can regulate the motion to allow the desired amounts of the lordotic movement despite variations in spinal compliance and in the individual's posture and position. The logic of the override control of the circuit is shown in FIGS. 1 and 2. Low force input (i.e. lower than the selected set force) from the force transducer measuring the support's force against the user's back is mediated by the logic box to signal the motor to spin forward. The forward spin is transmitted to the drive device to create forward displacement of the support to induce greater support to the user's spine. If input from the force transducer matches the selected set force range, the logic system signals the motor to rest in neutral with no motion of the drive device. The amount of time that the unit will maintain the neutral mode is a predetermined, adjusted, specific time frame long enough to provide a safe and comfortable spinal mobility as shown in FIGS. 1 and 2, typically, in cycle rates of five seconds or longer. When force input exceeds the selected set range, the logic system signals the motor to spin in reverse, causing the mechanism to revolve back away from the user's back. Force measurement against the user's back is measured continuously in order to provide the control logic box with instantaneous feedback.

The method described includes the steps of providing a mechanism to initiate continuous passive motion for the spine; providing a system for measuring the force exerted by the mechanism on an individual's spine; and providing a system for controlling the force exerted by the mechanism on an individual's spine.

While we have described our invention in connection with specific embodiments thereof, it is clearly to be understood that this is done only by way of example and not as a limitation to the scope of our invention as set forth in the objects thereof and in the appended claims.

We claim:

1. A method for providing force feedback in continuous passive motion systems, for use in treating or preventing low back pain and providing back comfort in an individual, comprising the steps of:

providing at least one static back support;

providing a mechanism adjacent to said static back support to initiate continuous passive motion for the lumbar area in order to produce lordotic motion for the spine;

providing a timer for the basic control of the mechanism;

providing a system for continuous measuring of the force exerted by the mechanism on an individual's lumbar area;

providing a logic system for continuous and automatic controlling of the force exerted by the mechanism on the individual's lumbar area in order to build up and then maintain a predetermined force on the lumbar area of the user for a predetermined period of time; and providing a predetermined period of time to allow the lordotic position of the spine to be returned to its original state such that flexion and extension alternately occur between adjacent vertebrae of the spine.

2. A method for providing force feedback in continuous passive motion systems, according to claim 1, whereby:

said providing a mechanism step comprises a mechanically driven unit.

3. A method for providing force feedback in continuous passive motion systems, according to claim 1, whereby:

said providing a mechanism step comprises a pneumatic operated unit.

4. A method for providing force feedback in continuous passive motion systems, according to claim 1, whereby:

said providing a continuous force measuring system comprises the use of force transducers for measuring the force exerted against the user's back.

5. A method for providing force feedback in continuous passive motion systems, according to claim 4, whereby:

said providing a controlling system step comprises said logic system for overriding the timer mechanism of the system based upon the reading of the transducers.

6. A method for providing force feedback in continuous passive motion systems, for use in treating or preventing low back pain and providing back comfort in an individual, comprising the steps of:

providing at least one static back support;

providing a mechanism adjacent to said static back support to initiate continuous passive motion for the lumbar area in order to produce lordotic motion for the spine;

providing a system for the continuous measuring of the force exerted by the mechanism on an individual's lumbar area;

providing a logic system for continuously and automatically controlling of the force exerted by the mechanism on an individual's lumbar area; and providing a predetermined period of time to allow the lordotic position of the spine to be returned to its original (least kyphotic) state such that flexion and extension alternately occur between adjacent vertebrae of the spine.

7. Means for providing force feedback in continuous passive motion systems, for use in treating or preventing low back pain and providing back comfort in an individual, comprising:

back support means;

said back support means comprising at least one static back support;

said back support means having a continuous force applying section adjacent to said static back support;

said force applying section having a mechanism for initiating continuous passive motion to an individual's lumbar area by said force applying section in order to produce lordotic motion for the spine such that flexion and extension alternately occur between adjacent vertebrae of the spine;

continuous force measuring means;

logic system means for continuous and automatic controlling of the operation of said force applying section based upon the measurements obtained from said force measuring means; and said continuous force measuring means comprises transducers that continuously monitor values below, equal to and above the predetermined levels and submit those values to said logic system in order to maintain a predetermined force on the lumbar area of the user for a predetermined period of time wherein said mechanism comprises a pneumatic unit.

* * * * *